US006634922B1

(12) United States Patent
Driscoll et al.

(10) Patent No.: US 6,634,922 B1
(45) **Date of Patent: *Oct. 21, 2003**

(54) ELECTRONIC RPM YO-YO

(76) Inventors: Robert W. Driscoll, c/o 42 Warren Ter., Longmeadow, MA (US) 01106; Edward Wood, c/o 42 Warren Ter., Longmeadow, MA (US) 01106; Peter Kristoffy, c/o Warren Ter., Longmeadow, MA (US) 01106

( * ) Notice: Subject to any disclaimer, the term of this patent is extended or adjusted under 35 U.S.C. 154(b) by 0 days.

This patent is subject to a terminal disclaimer.

(21) Appl. No.: 09/525,070

(22) Filed: Mar. 14, 2000

Related U.S. Application Data

(60) Provisional application No. 60/124,342, filed on Mar. 15, 1999.

(51) Int. Cl.[7] ..... A63F 13/00

(52) U.S. Cl. ..... 446/242; 446/244; 446/256; 463/1; 273/142 R

(58) Field of Search ..... 446/242, 246, 446/247, 250, 252, 254; 463/1, 15, 30, 31, 32, 33, 36–39; 273/142 R, 142 H, 143 R, 141 R, 147, 138.2, 369

(56) References Cited

U.S. PATENT DOCUMENTS

| | | | | | |
|---|---|---|---|---|---|
| 2,623,327 | A | * | 12/1952 | Testino | 446/242 |
| 3,162,979 | A | * | 12/1964 | Garoogian | 446/242 |
| 3,924,114 | A | * | 12/1975 | Sanchez | 446/242 |
| 4,327,518 | A | * | 5/1982 | Knauff | 446/242 |
| 4,775,948 | A | * | 10/1988 | Dial et al. | 702/149 |
| 4,820,979 | A | * | 4/1989 | Schwerdhofer et al. | 324/171 |
| 4,867,727 | A | * | 9/1989 | Lanius | 446/242 |
| 4,875,675 | A | * | 10/1989 | Arad et al. | 482/81 |
| 5,145,444 | A | * | 9/1992 | VanKuiken | 446/242 |
| 5,356,328 | A | * | 10/1994 | Ho | 446/242 |
| 5,446,775 | A | * | 8/1995 | Wright et al. | 377/24.2 |
| 5,791,966 | A | * | 8/1998 | Capps et al. | 446/242 |
| 6,077,145 | A | * | 6/2000 | Ma | 446/250 |
| 6,083,076 | A | * | 7/2000 | Saint-Victor | 446/242 |
| 6,287,193 | B1 | * | 9/2001 | Rehkemper et al. | 463/1 |

OTHER PUBLICATIONS

Tiger Electronics E–Yo Instruction Manual, 1999.*

Joe Blundo :When it comes to choosing toys, kids know best, 2 pages, Feb. 11, 1999.*

The Dallas Morning News Person@l Technology, Jul. 13, 1999.*

* cited by examiner

*Primary Examiner*—A. L. Wellington
*Assistant Examiner*—Yveste G Cherubin
(74) *Attorney, Agent, or Firm*—Deborah A. Basile

(57) ABSTRACT

The Electronic RPM Yo-Yo will contain electronics for purposes of measuring typical yo-yo game play including the speed and RPMs, the duration of the spin of the yo-yo and it will also calculate overall score based upon a combination of the speed and duration. It may also calculate the scale speed in miles per hour and the distance which the yo-yo would have traveled had it been rolling along a flat plane. The electronics will save high scores for each of the result categories. The high scores can be recalled. The electronics will include a sound transducer to provide audio signals that will alert a player when his current play has exceeded a high score. Results of game play will be conveyed using LCD read-out, a bar graph comprised of colored LEDs or heard audibly via a speaker and electronic speech. Results can also be transmitted to similar yo-yo's via IR (infrared) or IF radio frequency technology. Two or more players will then be compete against each other simultaneously by having the yo-yo's compare scores via this communication link.

6 Claims, 2 Drawing Sheets

ELECTRONIC RPM YO-YO

PRIOR APPLICATION

Provisional Patent Application filed Mar. 15, 1999 as Ser. No. 60/124,342, priority based upon that filing is requested.

BACKGROUND OF THE INVENTION

1. Field of the Invention

The invention relates to an improvement to the yo-yo toy such that the yo-yo will contain electronics for the purpose of measuring the spin speed in RPMs (rotations per minute) and the duration of the spin of a yo-yo during typical yo-yo play. The yo-yo through its electronic components will calculate an overall score based on a combination of the speed in RPMs and the duration of the spin of a yo-yo. The Electronic RPM Yo-Yo will also calculate the scale speed (in miles per hour) of the yo-yo play based on the known circumference of the yo-yo. Once the miles per hour is calculated, the electronic component will then calculate the distance which the yo-yo would have traveled had it been rolling along an even plane. The speed in RPMs will be measured in two distinct ways: (1) Peak speed and average speed. Either speed may be chosen by the player and the player may decide which speed, peak or average, is more important. This choice enhances play. The electronics will save "high scores" for each of the categories: (1) speeds (peak, average RPMs in MPH), (2) time, (3) distance and (4) overall score. The "high scores" can then be recalled with the touch of a button which will enable players to compete against each other as well as compete against their best score. The electronics will include a sound transducer, either a speaker or a piezo device, which will provide audio signals such as tones, speech or other sound that will alert the player when his current play has exceeded a high score for any of the scoring categories. This "high score" feature will be the catalyst for repeat play value which will lead to word-of-mouth sales.

The yo-yo will then convey the result measured or calculated to the player by various means. Results can be read via an LCD (liquid crystal display) read-out, rough or course results can be read via a bar graph comprised of colored LEDs (light emitting diodes) or results can be heard via a speaker and electronic speech. Results can also be transmitted to similar yo-yo's via infrared or radio-frequency technology. Two or more players will be able to compete against each other simultaneously by having the yo-yo's compare scores via this communication link.

2. Information Disclosure Statement

Currently in the field of art, there are yo-yos which have circuit boards disposed within them and a plurality of light emitting diodes mounted on the circuit boards to be controlled by the circuit boards. Switches are controlled by centrifugal forces generated by the rotation of the yo-yo and in some cases a speaker is also provided within the yo-yo structure to generate a sound when the yo-yo is rotated. Thus, the prior art contains yo-yo's with electric light and sound, yo-yo's with speed measurement and display and yo-yo's with digital watches or with means to calculate the number of revolutions. The prior art does not however teach an electronic game that is triggered by yo-yo play. A listing of prior patents is attached hereto.

BRIEF SUMMARY OF THE INVENTION

The Electronic RPM yo-yo will measure the speed in RPMs and the duration of the spin of a yo-yo during typical play. It will calculate an overall score based upon a combination of the speed and the duration of the spin. It will calculate the scale speed in miles per hour of a yo-yo. It will then calculate the distance which the yo-yo would have traveled if it were rolling along a flat plane. The electronics will save high scores for each of the result categories and high scores may be recalled with the touch of a button by a player. The electronics will include a sound transducer that will provide audio signals that will alert the player when his current play has exceeded a high score for any of the scoring categories. This high score feature will be the catalyst for repeat play value.

The results will then be conveyed to the player through various means such as liquid crystal display, light emitting diodes, speaker and electronic speech. Yo-yo's can communicate with each other during play via infrared or radio frequency technology. Two or more players will be able to compete against each other simultaneously by having the yo-yo's compare scores via this communication link.

Thus, this invention consists of a significant improvement in the game-playing capabilities of a yo-yo. The invention creates an intelligent, interactive yo-yo which provides for enhanced game-playing capabilities.

PREFERRED EMBODIMENT OF THE INVENTION

Figure 1:
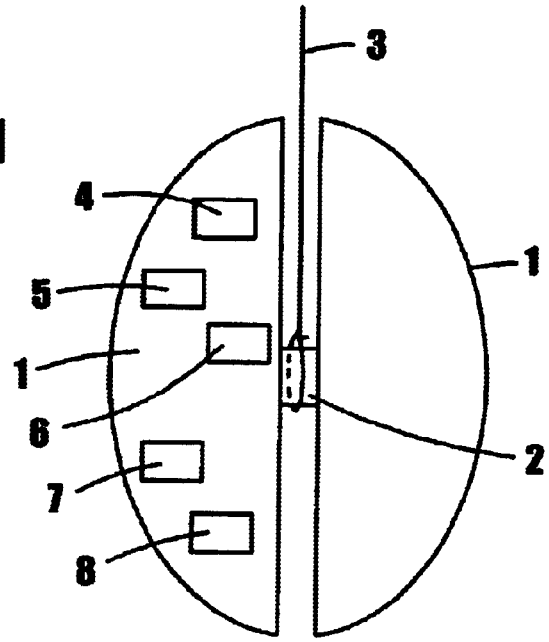
FIG. 1 is a drawing of the yo-yo device.
Figure 2:
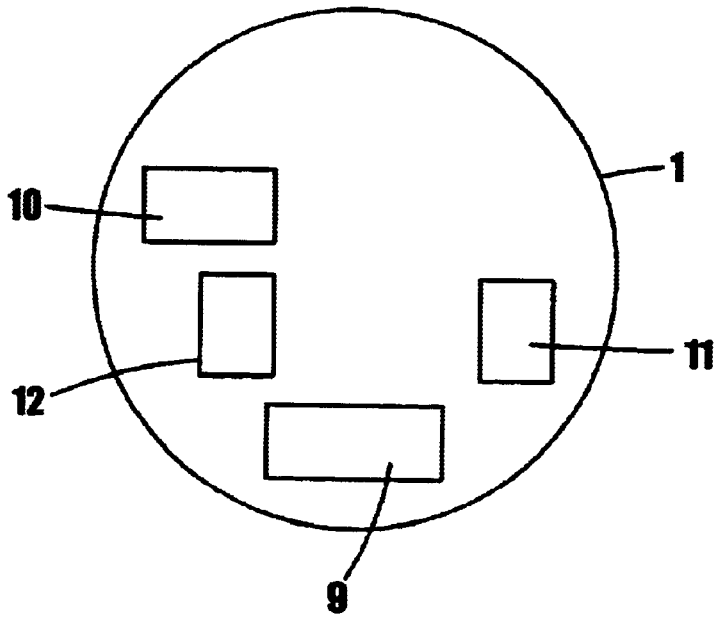
FIG. 2 is a drawing of one disk member of the yo-yo device.

General Description Referring to FIGS. 1 and 2

The invention is based on the concept of rendering a yo-yo interactive through electronics to improve game-playing capabilities. The preferred embodiment consists of two identical disk members (1), an axle which connects them, (2), and holds them apart. A string (3), loosely connected to the axle (2). Electronics which are all located in one of the diskmembers (1) as follows:

(1) Electronics to measure the spin (4), electronics to measure speed (5) in RPMs and the duration of the spin during typical yo-yo game play.

(2) Electronics to calculate an overall score based upon a combination of the speed and the duration (6).

(3) Electronics to calculate the scale speed in miles per hour (7) of the yo-yo based upon the known circumference of the yo-yo. Once the MPH is calculated, the yo-yo can calculate the distance which the yo-yo would have traveled if it were rolling along a flat plane.

(4) Speed will be measured in two distinct ways: peak speed and average speed. The player will choose which speed to measure and which speed is more important to particular play.

(5) Electronics will save high scores (memory) for each of the result categories: speed (peak, average RPMs and MPH), time, distance and overall score. High score can then be recalled with a touch of a button to enable the user to compete against other users or to compete against their own high score (9).

(6) Electronics will include a sound transducer either a speaker or a piezo device which will provide audio signals, tones, speech or other sounds which will alert the player when his current play has exceeded a high score for any of the scoring categories (8).

(7) The invention will convey results measured or calculated to the player through liquid crystal display (10), light emitting diodes (11) or via a speaker or electronic speech (8).

(8) Results can also be transmitted to similar yo-yo's via infrared or radio frequency technology (12). Two or more players will thus be able to compete against each other by having their respective yo-yo's compare scores via this communication link.

Figure 3:
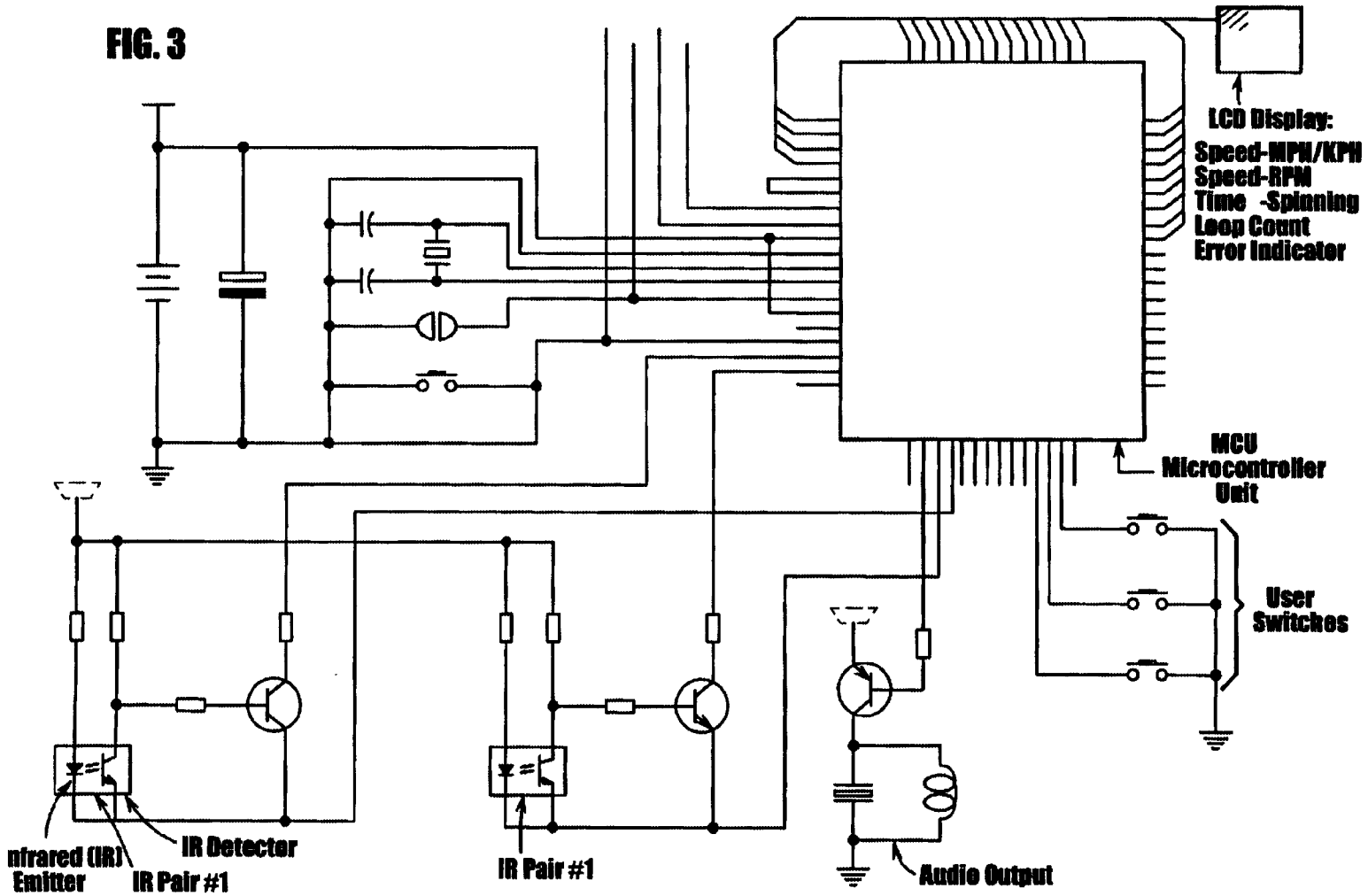
FIG. 3 is a schematic of the electronics of the yo-yo device.

Referring to FIG. 3, in the Preferred Embodiment, the electronics will be separately switch accessed so that results can be obtained easily without significant interaction by the player. When the user spins the yo-yo, a switch can close to turn on the electronics. The electronics will then shut off automatically after a minute or two of non-use. The results from the spin will be cycled automatically without the need for user input. This will allow the user to play with the yo-yo right out of the package without needing to read an instruction manual.

The Electronic RPM Yo-Yo will be programmed with software which will sense not only when the yo-yo has stopped but also when its string has not been recoiled. This will allow for two types of results: (1) informational only and (2) validated scores. The player must get the yo-yo to retract in order to get valid scores (scores that can potentially be saved as "high scores"). If the user spins the yo-yo and it does not retract, he can still get results in speed, time and distance. The yo-yo will have a switch to make it easier for the user to alternate the display mode between the various measurements, i.e., speed in RPMs, duration in seconds and speed in miles per hour, distance in feet and overall score.

In its preferred embodiment there are three methods to achieve the goals for measuring the yo-yo's speed. The first two methods involve sensing light that is either reflected off of the yo-yo string or interrupted by the string. There may be one or more sensors within the apparatus of the device. The third method involves the sensing of magnetic material embedded in the end of the string nearest the axle of the yo-yo. A cylindrical piece that fits over the yo-yo's axle and rotates with the string may also be used to trigger or one more sensor. This piece would contain a marker (either an arm for light or a magnet). The spin time can be measured by starting a timer when the yo-yo spins and stopping the timer when the yo-yo stops. This leads to a less expensive version of this electronic yo-yo which would only provide the user with the duration of spin. This embodiment would have the same basic set of electronics minus the sensor and source (LED or magnetic) material.

Method One

Reflective Light. The most cost effective method of operation would be the reflective light method because all of the electronics can be housed in one half of the yo-yo apparatus. This method does not require any special alignment upon assembly of the yo-yo. In this method, the light emitting surface of the LED (light emitting diode) will be in the same plane as the sensor surface of the light sensor (photo resister). The inner sides of both halves of the yo-yo will ideally have a flat black colored surface to reduce reflectivity. When the yo-yo is in operation, the white string will reflect the light from the LED back to the sensor. The differences in reflectivity between the white string and the flat black surface should be sufficient to trigger the light circuit.

The following electronic components will be required for this method:

(a) A small printed circuit board (pcb) with an inexpensive micro-controller, LED (light emitting diode), light sensor circuit, photo resister (with two to three resisters and capacitors), batteries, switches (an elastomeric mode switch in a centrifical force switch) and output device (LCD, LED, or speaker) as described herein.

Also in the preferred embodiment, the light sensor and light source may be replaced with an infrared emitter/detector pair) to accomplish the same goal. Although the infrared method will provide increased performance, it will also be more expensive.

Method Two

Direct Light. In this method, the LED will be in one half of the yo-yo with its own battery and centrifigual force switch. The photo sensor will be in the other half of the yo-yo with the rest of the electronics. The LED will have to be aligned directly opposite the photo sensor upon assembly so that the light from the LED will illuminate the surface of the photo sensor.

Electrical components required for this Method Two: (a) a small pcb with an inexpensive micro controller, photo sensor circuit, batteries, switches, and output device in one-half of the yo-yo; plus an LED, batteries and centrifugal force switch in the other half of the yo-yo.

Method Three

Magnet Sensor: This method will be similar to the first method in that all of the electronics will be contained in one-half of the yo-yo. The electronics will consist of a magnetic sensor (a hall-effect device), an inexpensive micro controller, LCD, a few discreet components, batteries and switches (similar to the first method). The area of this string that is closest to the axle of the yo-yo will either be in a magnetic band wrapped around it or a magnetic material bonded to the string.

Electronic components required for Method Three: (a) a small pcb with an inexpensive micro controller, a hall-effect device, two to three resisters, two to three capacitors, batteries, switches (an elastomeric mode switch and a centrifical force switch) and output device. The yo-yo will also require magnetic material on the bottom one inch of the string.

In the preferred embodiment of the invention, the following methods of operation for outputting results will be implemented.

(1) LCD RPM Yo-yo (LCD Output)

This version of the RPM yo-yo will include an LCD device embedded in the housing. This device will allow the user to read the speeds, duration of spin, overall score and high score. The LCD will include numerals for displaying said information along with labels such as "RPMs", "SECS" and;"high score".

(2) Red Line Yo-yo (LED Bar Graph Output)

This version will include a set of miniature LEDs (three of each color: green, yellow and red) housed in the yo-yo plastics, such that the LEDs form a line starting at the center and advancing to the outer edge of the yo-yo. These LEDs will be visible from the side view of the yo-yo. The inner-most three LEDs will be green, the three middle LEDs will be yellow and the three outer-most LEDs will be red. The speeds (RPM and mph), duration and scores will be displayed via this bar graph where performance will be directly related to which LED lights up. The better the performance, then the further out the activity LED will appear. For example, if testing shows that yo-yo's can reach a maximum speed of just 600 RPMs and will spin slowly at 100 RPMs, then the inner-most LED will be programmed to light at 100 RPMs while the outer-most LED will be programmed to light at 600 RPMs (the other LEDs would then light in a linear fashion between these two points. High scores will be displayed in the same fashion as described above.

The addition of LEDs to the side of the yo-yo will allow for this yo-yo to display a light show while the yo-yo is spinning. This light show can simply display a bar graph related to the current spin speed (actually the spinning LED would create a ring of light) or it could allow the user to select a pre-programmed light show from the memory of the yo-yo (i.e., rings of light going in and out).

3. Talking RPM Yo-yo (Electronic Speech Output)

This version will include a small speaker or a piezo device for outputting electronic speech. The micro-controller will be capable of outputting electronic speech which is typically available on these parts. The results (speed, duration, overall score, and high score) will be announced through the speaker or piezo upon a completion of the spin and/or the pressing of the mode switch.

The addition of a speaker will also allow this version to elicit sounds while the yo-yo is being released, spun and retracted. For example, the yo-yo can scream as you release it, then hum, play a melody, or make strange sounds while it is spinning and make a "boing" sound when it returns.

We claim:

1. A yo-yo toy structure comprising;

a body having two identical disk members, each having an inner surface and an outer surface, said disk members being mounted on an axle in such a way as to define a space between two said inner surfaces of said disk members;

a string which is loosely engaged around said axle within said space between said inner surfaces of said disk members;

two dome-like cover members respectively mounted on the outer surfaces of said disk members;

an electronic means disposed entirely within one of said disk members to measure a spin speed of said disk members in rotations per minute;

an electronic means disposed entirely within one of said disk members to measure a duration of spin of said disk members;

an electronic means disposed entirely within one of said disk members to calculate an overall score based upon a combination of the spin speed and the duration of spin;

an electronic means disposed entirely within one of said disk members to calculate a scaled speed in miles per hour of said disk members and an equivalent distance; and an electronic sound transducer disposed entirely within one of said disk members to provide audio signals, tones, speech or audible sound.

2. A yo-yo toy structure comprising;

a body having two identical disk members, each having an inner surface and an outer surface, said disk members being mounted on an axle in such a way as to define a space between two said inner surfaces of said disk members;

a string which is loosely engaged around said axle within said space between said inner surfaces of said disk members;

two dome-like cover members respectively mounted on the outer surfaces of said disk members;

an electronic means disposed entirely within one of said disk members to measure a spin speed of said disk members in rotations per minute;

an electronic means disposed entirely within one of said disk members to measure a duration of spin of said disk members;

an electronic means disposed entirely within one of said disk members to calculate an overall score based upon a combination of the spin speed and the duration of spin;

an electronic means disposed entirely within one of said disk members to calculate a scaled speed in miles per hour of said disk members and an equivalent distance;

an electronic, sound transducer disposed entirely within one of said disk members to provide audio signals, tones, speech or audible sound; and an electronic means disposed entirely within one of said disk members for measuring speed as either peak speed or average speed.

3. The yo-yo toy structure of claim 1 wherein said electronic means includes a memory feature to store information relative to game play such as high scores in each of the following categories: speed, time, distance and overall score, said memory feature having an electronic recall mechanism to enable a user to receive prior scores and compete against prior users.

4. The yo-yo toy structure of claim 3 wherein one of said disk members has embedded within it electronic means for a liquid crystal display and said outer surface of said disk member having a liquid crystal display screen to display scores to the user.

5. The yo-yo toy structure of claim 3 wherein said disk member has embedded within it light emitting diodes.

6. A yo-yo toy structure comprising;

a body having two identical disk members, each having an inner surface and an outer surface, said disk members being mounted on an axle in such a way as to define a space between two said inner surfaces of said disk members;

a string which is loosely engaged around said axle within said space between said inner surfaces of said disk members;

two dome-like cover members respectively mounted on the outer surfaces of said disk members;

electronic means disposed entirely within one of said disk members to measure a spin speed of said disk members in rotations per minute, wherein said speed is measured as either a peak speed or an average speed;

electronic means disposed entirely within one of said disk members to measure a duration of spin of said disk members;

electronic means disposed entirely within one of said disk members to calculate an overall score based upon a combination of the spin speed and the duration of spin;

electronic means disposed entirely within one of said disk members to calculate a scaled speed in miles per hour of said disk members and an equivalent distance;

an electronic sound transducer disposed entirely within one of said disk members to provide audio signals, tones, speech or audible sound;

said electronic means includes a memory feature to store information relative to game play such as high scores in each of the following categories: speed, time, distance and overall score, said memory feature having an electronic recall mechanism to enable a user to receive prior scores and compete against prior scores;

one of said disk members has embedded within it electronic means for a liquid crystal display and said outer surface of said disk member having a liquid crystal display screen to display scores to the user;

said disk member has embedded within it light emitting diodes; and one of said disk members has embedded within it electronic means for receiving and transmitting infrared or radio frequency communication such that two or more players may exchange information and compete against each other.

* * * * *